US005333814A

United States Patent [19]

Wallis

[11] Patent Number: 5,333,814

[45] Date of Patent: Aug. 2, 1994

[54] TOWED AERODYNAMIC BODIES

[75] Inventor: Graham P. Wallis, Stevenage, Great Britain

[73] Assignee: British Aerospace Public Limited Co., Farnborough, England

[21] Appl. No.: 51,383

[22] Filed: Apr. 23, 1993

[30] Foreign Application Priority Data

Apr. 25, 1992 [GB] United Kingdom ..... 9209017

[51] Int. Cl.[5] ..... B64D 3/00

[52] U.S. Cl. ..... 244/1 TD; 89/1.11; 244/3

[58] Field of Search ..... 244/2, 3, 1, 121, 34 A; 89/1.11; 342/13

[56] References Cited

U.S. PATENT DOCUMENTS

| | | | |
|---|---|---|---|
| 1,729,354 | 9/1929 | Mounce | 244/3 |
| 2,634,924 | 4/1953 | Brown | 244/3 |
| 2,649,262 | 8/1953 | Fahrney | 244/3 |
| 2,918,229 | 12/1959 | Lippisch | 244/34 A |
| 3,012,534 | 12/1961 | Thomas | 89/1.11 |
| 3,113,747 | 12/1963 | Smith | 244/3 |
| 4,354,419 | 10/1982 | Patterson | 89/1.11 |
| 4,421,007 | 12/1983 | Hanes | 89/1.11 |
| 4,718,320 | 1/1988 | Brum | 89/1.11 |
| 4,852,455 | 8/1989 | Brum . | |
| 5,029,773 | 7/1991 | Lecat | 244/1 TD |
| 5,092,244 | 3/1992 | Giglia | 89/1.11 |

FOREIGN PATENT DOCUMENTS

| | | |
|---|---|---|
| 2613953 | 10/1977 | Fed. Rep. of Germany . |
| 944798 | 12/1963 | United Kingdom . |
| 1367758 | 9/1974 | United Kingdom . |
| 1470356 | 4/1977 | United Kingdom . |

OTHER PUBLICATIONS

Expendable Decoys By Martin Streetly, International Defense Review Aug. 1990 From Planning-Rae-F Borgh pp. 878-881.

H679, Czajkowski SIR published Sep. 5, 1989.

*Primary Examiner*—Galen L. Barefoot

*Attorney, Agent, or Firm*—Cushman, Darby & Cushman

[57] ABSTRACT

An airborne body (1) towed behind an aircraft (2) is manoeuvrable around the flight path of the aircraft in order to intercept or collide with an incoming threat and thus protect the aircraft either by directly damaging the threat or causing it to fuze prematurely. Means for steering the body may take the form of control lines (3*a*, 3*b*, 3*c*) operated by winches (8).

11 Claims, 2 Drawing Sheets

TOWED AERODYNAMIC BODIES

Figure 1:
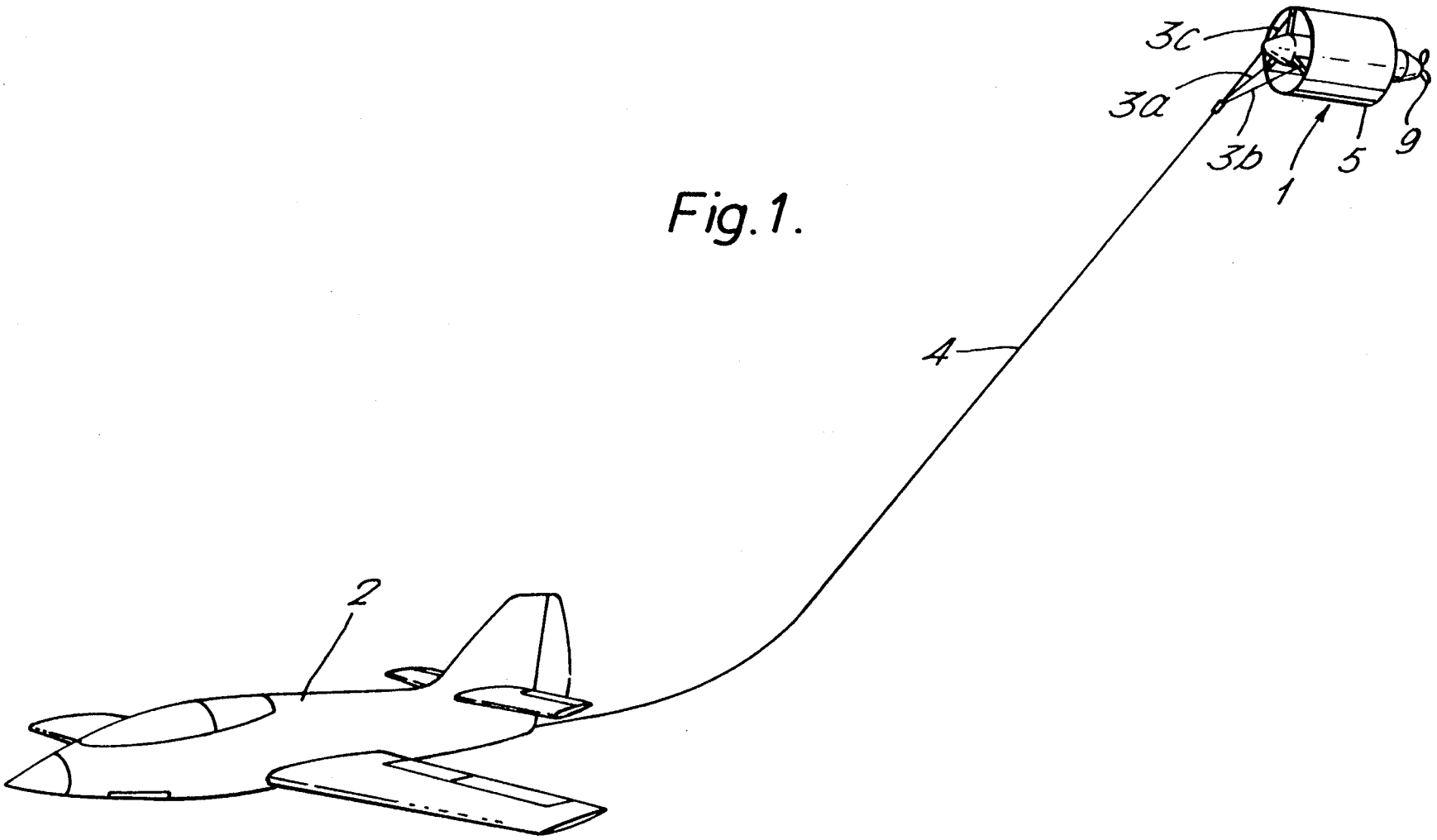

This invention relates to airborne bodies which are towed behind an aircraft or a ship for example.

Towed bodies may be used as decoys in order to seduce a hostile missile away from the towing aircraft. Such decoys are described in Intl. Defense Review 8. 1990. p881. Known decoys are entirely passive and because they fly directly behind the aircraft, they cannot cause a missile approaching from near head or tail on to the aircraft to deviate from a collision course with the aircraft.

This invention consists of a body for towing by a vehicle, the body including means for manoeuvring the body laterally with respect to the path of the vehicle, whereby the body is able to intercept a projectile.

The body may thus have application as a defensive weapon for intercepting and destroying a hostile missile before the missile reaches the towing vehicle.

The body may be configured as a decoy, able to seduce an approaching missile off the towing vehicle's flight path, even when the missile is approaching from the rear of the towing vehicle.

The body is conceptually similar to a steerable kite and its manoeuvrability allows it to intercept an incoming threat thereby protecting the towing vehicle either by directly damaging the threat or by causing it to fuze prematurely.

The body may also have application as a towed target for trials purposes. Its ability to fly off the towing vehicle's flight path significantly reduces the chances of inadvertent damage being done to the towing vehicle in near-miss or tail attack situations.

The body may be steered by control lines actuated at the towing vehicle or by an actuation mechanism mounted on the body.

In the case of body-mounted actuators, the power for control may be derived from stored energy systems, transmission of electrical power down the towing cables, or by a wind-driven turbine incorporated within the body.

Sensors which detect the presence of a threat may be employed together with a guidance computer for generating steering signals for the actuators. The sensors could be mounted on the body or on the towing vehicle. The latter case requires the provision of a communications link between the towing vehicle and any body-mounted actuators.

Optionally, the body may include devices to enable it to decoy a threat away from the towing vehicle. Such devices could comprise infra-red radiation emitters and/or radar reflectors, and/or active electronic countermeasures.

Optionally, the body may include ordnance devices to damage the incoming threat and associated impact or proximity fuzes.

Multiple bodies may be used to intercept multiple threats or to increase the probability of successful interception of the threat. The bodies may also be cascaded.

Deployment from the towing vehicle could be done by winching the body out from an aircraft-mounted pylon, for example. The body could be recoverable, by being provided with means for winching it in, back to its stowed position. Alternatively, the body could be jettisoned from the towing vehicle in a one-shot deployment mode.

Figure 2:
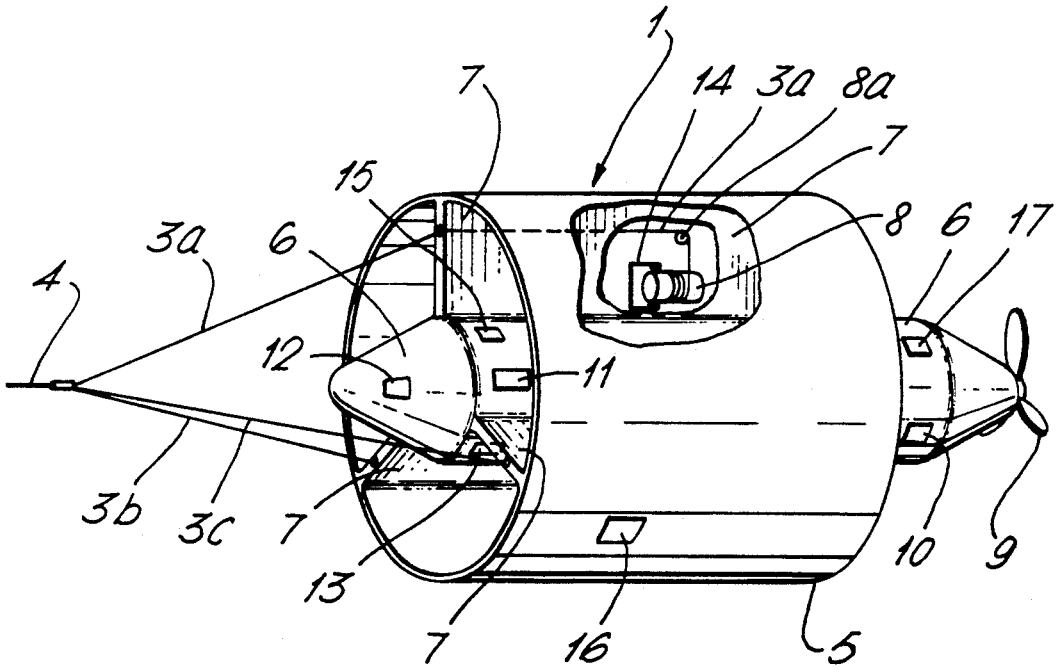

Some embodiments of the invention will now be described by way of example only with reference to the drawings of which:

FIG. 1 is a schematic diagram showing deployment of a towed body in accordance with the invention; and FIG. 2 is a partly-sectioned perspective view of the body of FIG. 1.

In the FIG. 1 a steerable airborne body 1 is attached to an aircraft 2 by means of three control lines 3*a*, 3*b*, 3*c* and a tow line 4. By paying out the control lines by different amounts, the body 1 can be manoeuvred laterally around the flight path of the aircraft 2.

In FIG. 2, the body 1 comprises a cylindrical part 5 and a central aerodynamically-shaped support 6 which is joined to the cylindrical part 5 by three aerofoil struts 7. The struts 7 are disposed at approximately 120° to one another and within each strut is carried a winch 8. Each winch 8 with an associated guide pulley 8*a* controls an associated control line 3*a*, 3*b*, 3*c* thereby steering the body 1.

Mounted on the aft portion of the central support 6 is a turbine 9 which is wind-driven and used to generate the electrical power required by the body 1.

The support 6 contains a Doppler radar 10, explosive charge 11 and proximity fuze 12, and a guidance computer 13.

When deployed and the aircraft 2 comes under threat from a missile, the Doppler radar 10 detects the presence and direction of approach of the missile and passes the relevant data to the guidance computer 13. The guidance computer 13 then activates the winches 8 so that the body 1 moves to a position ready to intercept the missile.

If the missile fails to detonate before impact with the body 1 or if it misses, the body's own fuze 12 and explosive charge 11 will ensure the missile's destruction.

Movement of the body 1 is achieved by the relative extension of the three control lines 3*a*, 3*b*, 3*c*. Each winch 8 associated with each control line is provided with a brake 14 which is released when need be in order to allow a control line to pay out under tension. Thus the body 1 is steered by differential release of the three brakes 14 associated with each winch 8.

The brakes 14 can be operated by any one of several, suitable known means, for example, by a clockwork escapement mechanism, having a solenoid-operated spring.

The control lines 3*a*, 3*b*, 3*c* are therefore payed out every time a new manoeuvre is demanded, so the useful duty cycle is limited. This limitation can be removed, however, by providing a winch which can wind the control lines back in during quiescent periods. This can be done by using a highly-geared motor powered by the turbine 9.

In a second embodiment, the body of FIG. 2 is configured as a decoy and further incorporates a radar enhancement device 16 on the outer surface of its cylindrical part 5 and an infra-red source 17. In this embodiment, on detection of the threatening missile, the guidance computer 13 activates the winches 8 so that the body 1 moves to a position away from the line between missile and aircraft 2 in order to lure the missile away from the aircraft 2.

The use of the infra-red source 17 and the radar enhancement device 16 serve to make the body 1 a more attractive target then the aircraft 2.

When the body 1 has completed its manoeuvre, the missile will change course in order to collide with the body 1 instead of the aircraft If the missile fails to detonate before impact with the body 1 or if it misses, destruction of the missile can be ensured by the action of the explosive charge 11 and fuze 2.

In further alternative embodiments of the body 1, the threat sensor 10 could take the form of an infra red imager with search and track facilities, or a television tracker, or a means for detecting radiation associated with the missile (heat or radar or laser emissions for example).

A further alternative guidance technique could be one employing proportional navigation- On-board sensors such as one or more accelerometers 15 are then incorporated within the body 1. An on-board accelerometer also provides the body 1 with a means for detecting instability of the body 1 in flight. Instabilities can arise due to inertia of the towing cable 4 and control lines 3*a*, 3*b*, 3*c*. An accelerometer 15 for detecting the onset of unstable behaviour would output a control signal to one or more of the winch brakes 14, allowing paying out of one or more control lines until stable flight conditions were resumed.

The guidance computer 13 could, in an alternative embodiment, form part of a three-point interception system using command to line-of-sight from a threat sensor mounted on the aircraft 2. In such an arrangement, the threat sensor tracks both missile and body 1 and provides the body 1 with guidance commands. The commands could be transmitted to the body 1 from the aircraft 2 by a data link or a beam rider. In the latter case, the body's guidance computer 13 would interrogate the beam to find an error and calculate the necessary guidance computation.

Certain threat missiles will themselves be controlled by a three point guidance system (CLOS or beam rider), employing an active tracking beam which is directed onto the aircraft 2 and onto which the threatening missile is steered. In such cases where this beam can be detected by the body mounted sensor 10 or the aircraft mounted sensor, the body 1 may be steered onto the same beam to effect an interception, without the need for detecting the threatening missile itself.

I claim:

1. A body for towing by a vehicle, said body including a plurality of control lines each for connection between a two cable and an associated actuation mechanism mounted on said body, each said actuating mechanism including a system for reeling out and reeling in said control lines thereby to laterally manoeuvre said body with respect to a path of the vehicle, whereby the body can intercept a projectile.

2. A body as claimed in claim 1 and having the form of an outer cylindrical part connected to a central support by means of at least one aerofoil strut.

3. A body as claimed in claim 1 in which the actuation mechanism comprises a braked winch.

4. A body as claimed in claim 1 in which the means for manoeuvring the body are controlled by an output from a body-mounted sensor which senses the presence of a threat.

5. A body as claimed in claim 4 in which the body-mounted sensor is a Doppler radar.

6. A body as claimed in claim 4 in which the body-mounted sensor responds to radiation emitted by or associated with the threat.

7. A body as claimed in claim 1 and incorporating an explosive charge.

8. A body as claimed in claim 7 and incorporating a proximity fuze.

9. A body as claimed in claim 1 and incorporating an infra-red radiation emitter.

10. A body as claimed in claim 1 and incorporating a radar enhancement device.

11. A body as claimed in claim 1 and incorporating a wind-driven turbine.

* * * * *